US006839037B1

(12) United States Patent
Stokes et al.

(10) Patent No.: US 6,839,037 B1
(45) Date of Patent: Jan. 4, 2005

(54) DUAL CIRCULAR POLARIZATION WAVEGUIDE SYSTEM

(75) Inventors: Jamie Stokes, Berkshire (GB); Andrew Patrick Baird, Hampshire (GB); Fiona Isabel Bruce, Berkshire (GB)

(73) Assignee: Channel Master Limited, Berkshire (GB)

( * ) Notice: Subject to any disclaimer, the term of this patent is extended or adjusted under 35 U.S.C. 154(b) by 0 days.

(21) Appl. No.: 10/148,103

(22) PCT Filed: Nov. 23, 2000

(86) PCT No.: PCT/GB00/04440

§ 371 (c)(1),
(2), (4) Date: Jul. 9, 2002

(87) PCT Pub. No.: WO01/39317

PCT Pub. Date: May 31, 2001

(30) Foreign Application Priority Data

Nov. 26, 1999 (GB) ..... 9928095

(51) Int. Cl.[7] ..... H01Q 13/00
(52) U.S. Cl. ..... 343/786; 343/772; 343/776
(58) Field of Search ..... 343/786, 772, 343/773, 776, 783, 784, 756; 333/21 A, 21 R, 33, 97 R, 98 R, 125, 137

(56) References Cited

U.S. PATENT DOCUMENTS 4,071,833 A * 1/1978 Gould ..... 333/33
4,126,835 A * 11/1978 Gould ..... 333/21 A
4,959,658 A 9/1990 Collins ..... 343/786
5,216,432 A 6/1993 West ..... 343/786
5,459,441 A 10/1995 Weber et al. ..... 333/136
6,118,412 A * 9/2000 Chen ..... 343/756

FOREIGN PATENT DOCUMENTS

JP 60 176302 9/1985 ..... H01P/1/213
JP 06 283913 2/1995 ..... H01P/5/107

* cited by examiner

*Primary Examiner*—Hoang V Nguyen
(74) *Attorney, Agent, or Firm*—Darby & Darby

(57) ABSTRACT

A dual circular polarization waveguide (24) is described which has a septum (36) which divides the waveguide (24) into two separate compartments (38, 40) each with a probe (30A, 30B) passing through the end wall (32) of the waveguide (24) into the compartment (38, 40) to detect respective signals in each of the compartments (38, 40). The septum (36) is proportioned and dimensioned to convert the left and right circularly polarized signals, into substantially linearly polarized signals as the signals pass along the waveguide (24) past the septum (36) so as by the time the signals reach the probes (30A, 30B) they are linearly polarized. The probes (30A, 30B) which pass through the rear wall (32) of the waveguide (24) are oriented such that they couple into the magnetic field of the primary or fundamental waveguide mode. These probes (31A, 30B) do not require to be orthogonal to each other but each probe (31A, 30B ) has a free end disposed in proximity to a waveguide wall or the septum (36) within a respective compartment (38, 40) so that the probe (30A, 30B) is capacitively coupled to the waveguide wall or septum (36) to allow the probe (30A, 30B) to couple into the respective magnetic field in the compartment (38, 40).

15 Claims, 13 Drawing Sheets

| | MARKER POSITION | 1: (dB) | 2: (dB) | MARKER POSITION | 1: (dB) | 2: (dB) |
|---|---|---|---|---|---|---|
| 1 | 12.2000 GHz | -7.65 | -8.10 | | | |
| 2 | 12.7050 GHz | -7.36 | -8.14 | | | |

CURVED SEPTUM IN SQUARE WAVEGUIDE

DUAL CIRCULAR POLARIZATION WAVEGUIDE SYSTEM

The present invention relates to a dual circular polarity probe waveguide system, and to a waveguide for use in such a system, for receiving circularly polarised signals and for converting the circularly polarised signals into linearly polarised signals.

In many jurisdictions, such as the United States and South America, the polarisation system used to transmit satellite signals is known as Dual Circular (Left and Right Polarisation), as opposed to Dual Linear as is used in Europe and other parts of the world.

Broadcasting standards to meet certain design criteria in signal reception are becoming more demanding. One example is the current U.S. Standard for isolation performance which requires a 25 dB signal separation is between left and right hand circular polarised signals. This standard is exceedingly difficult to achieve in a single waveguide over the whole of the required frequency band. In the United States the frequency band is 12.2–12.7 GHz and the frequency band in South America, Russia and many other countries is 11.7–12.2 GHz. Ideally it is desirable to manufacture a single waveguide for use in a low noise block or the like which can be used in all of the countries and satisfies the isolation standards for each of the countries across the whole of the band in these respective countries.

It is known to use a stepped septum polariser to convert circular polarisation to linear polarisation, as disclosed in a paper by Chen, M H and Tsandoulas, G N (Communications, 1973). When used in a signal receiving system, the left and right circular polarised signals are separated into different rectangular waveguides and propagate in the TE10 mode. In the above paper the signals pass through the waveguide for further processing and/or detection. There is no disclosure as to how such further processing and/or detection is achieved.

U.S. Pat. No. 5,245,353 to Gould discloses a waveguide with dual probes extending through a back wall coaxially into the waveguide. In this arrangement the probes are oriented such that each probe couples to a primary waveguide mode but does not couple to a first higher waveguide mode or the TEM mode. This is achieved by arranging the probes so that they are orthogonal to each other and to the primary waveguide modes such as TE11 in the circular waveguide.

A disadvantage of this arrangement is that the orthogonal probes are located in a single waveguide and some cross-coupling still occurs between the probes limiting the isolation between the orthogonally polarised signals.

U.S. Pat. No. 5,331,332 discloses a rectangular waveguide with a single probe launched from the end of the waveguide and a partial transmission wall extending along the waveguide from the rear wall of the waveguide and surrounding part of the probe. The transmission wall is stated to enhance the transmission of microwave signals therealong and also to allow adjustment of impedance presented to the waveguide by the transmission walls. This waveguide structure is relatively difficult to manufacture and there is no disclosure of converting circularly polarised signals into linearly polarised signals.

An object of the present invention is to provide an improved waveguide which obviates or mitigates at least one of the disadvantages of aforementioned waveguides.

This is achieved by providing a symmetrical waveguide which has a septum which divides the waveguide into two separate compartments each with a probe passing through the end wall of the waveguide into the compartment to detect respective signals in each of the compartments.

The septum is proportioned and dimensioned to convert the left and right circularly polarised signals, into linearly polarised signals as the signals pass along the waveguide past the septum so that by the time the signals reach the probes they are linearly polarised. The probes which pass through the rear wall of the waveguide are oriented such that they couple into the magnetic field of the primary or fundamental waveguide mode. These probes do not require to be orthogonal to each other but each probe has a free end disposed in proximity to a waveguide wall or the septum within a respective compartment so that the probe is capacitively coupled to the waveguide wall or septum to allow the probe to couple into the respective magnetic field in the compartment.

One of the main advantages of this arrangement is that it provides excellent isolation between the probes since they are effectively contained in different waveguides. This results in a waveguide and LNB which provides isolation in excess of the 25 dB specification across the whole of the 11.7–12.7 GHz band used in the United States, South America and other countries.

According to a first aspect of the present invention there is provided a dual probe waveguide structure for use in a LNB (low noise block) for receiving a left (L) and a right (R) circularly polarised electromagnetic radiation signal and for converting the circularly polarised signals into linearly polarised signals, the waveguide structure comprising:

a waveguide housing of a substantially symmetrical cross section, said waveguide housing having a front aperture and a rear waveguide wall, a septum disposed within the housing and coupled to the rear waveguide wall and the housing to separate the waveguide into two waveguide compartments, one compartment for receiving and converting the left circular polarisation signal into a first linearly polarised signal and the other compartment for receiving and converting the right circular polarised signal into a second linearly polarised signal orthogonal to the first linearly polarised signal, a first probe extending into said first waveguide compartment from the rear waveguide wall and a second probe extending into the second rear waveguide compartment from the second waveguide wall the first and second probes each having a free end, the probes being oriented and arranged such that the free ends of the probes are disposed in proximity to the waveguide wall or septum in each respective compartment such that the probes capacitively couple into the magnetic field of the primary or fundamental waveguide mode in the waveguide compartment.

Preferably, the waveguide housing is square in cross-section. Alternatively, the waveguide housing is circular in cross-section.

Preferably also, the septum is stepped. Alternatively, the septum is non-stepped and has a curved edge.

Preferably, the rear wall of the waveguide is integral with the waveguide housing. Alternatively, the waveguide wall is provided by a ground plane of a circuit board disposed at the end of the waveguide.

Conveniently, two probes are mounted in the circuit board, one probe extending into a respective compartment.

Conveniently, the probes are circular in cross-section. Alternatively, the probes may be of any other suitable cross-section, such as square, rectangular, hexagonal or triangular which maximises the coupling of the magnetic field from the compartment.

Preferably, each of the probes has a first portion which extends substantially parallel to the waveguide axis into the respective waveguide compartment and a second portion coupled to the first portion at an obtuse angle, each second portion having its free end disposed towards the septum and the leading end of the other probe.

Preferably the free ends of the probes converge towards each other and towards the septum. Alternately the free ends of the probes diverge from the septum towards the waveguide wall.

Preferably the probes are located in respective compartments such as to be reflected about the plane of the septum.

Preferably also, the waveguide housing, rear wall and septum, are formed from a die-cast metal selected from aluminium, zinc, magnesium or alloys of these elements such as MAZAC, a zinc alloy; LM24 an aluminium alloy, and AZ91D, a magnesium alloy.

Conveniently, the septum is substantially the same thickness from the rear wall to the stepped or curved edge of the septum, the septum having a draft angle about 1° per side to facilitate release of the waveguide after being die-cast.

According to a further aspect of the present invention, there is provided a method of converting left and right circularly polarised signals into linearly polarised signals comprising the steps of:

passing a left and right circularly polarised combined signal into a waveguide housing, separating the left and right circularly polarised signals within the housing and converting the circular polarisation of the left and right circular polarised signals into linearly polarised signals, passing the separated linearly polarised signals into different waveguide compartments to isolate the linearly polarised signals from each other, and coupling into the magnetic field of the primary or fundamental waveguide mode for each signal within said waveguide compartments.

These and other aspects of the present invention will become apparent from the following description, when taken in combination with the accompanying drawings, in which:

FIG. 1 is a diagrammatic view of a low noise block in accordance with a preferred embodiment of the present invention;

FIG. 2*a* is a perspective and partly broken-away view of the waveguide shown in FIG. 1 with a waveguide wall removed;

FIG. 2*b* is a similar view to FIG. 2*a*, from a different angle, with the waveguide walls removed;

Figure 1:
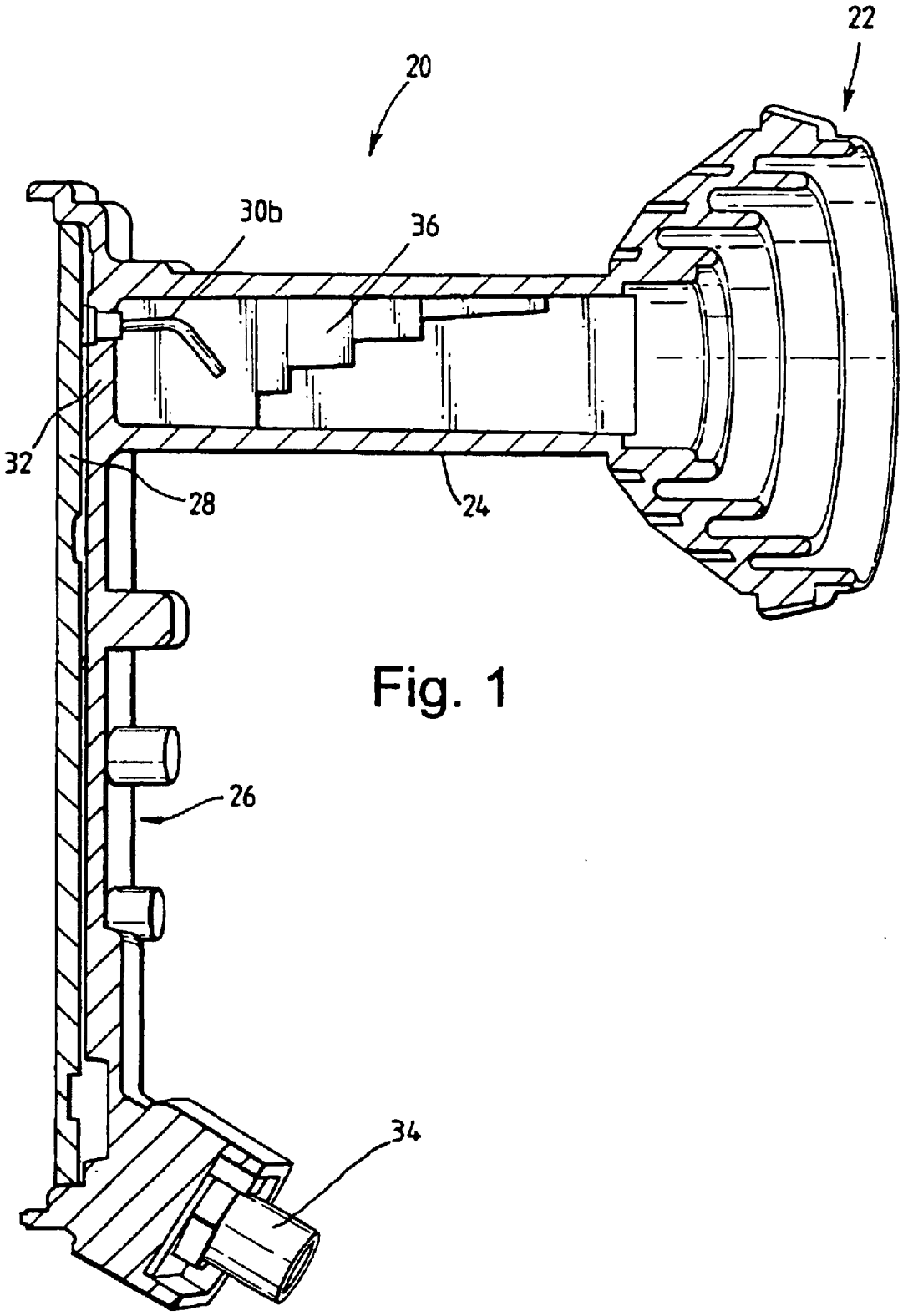
Figure 4:
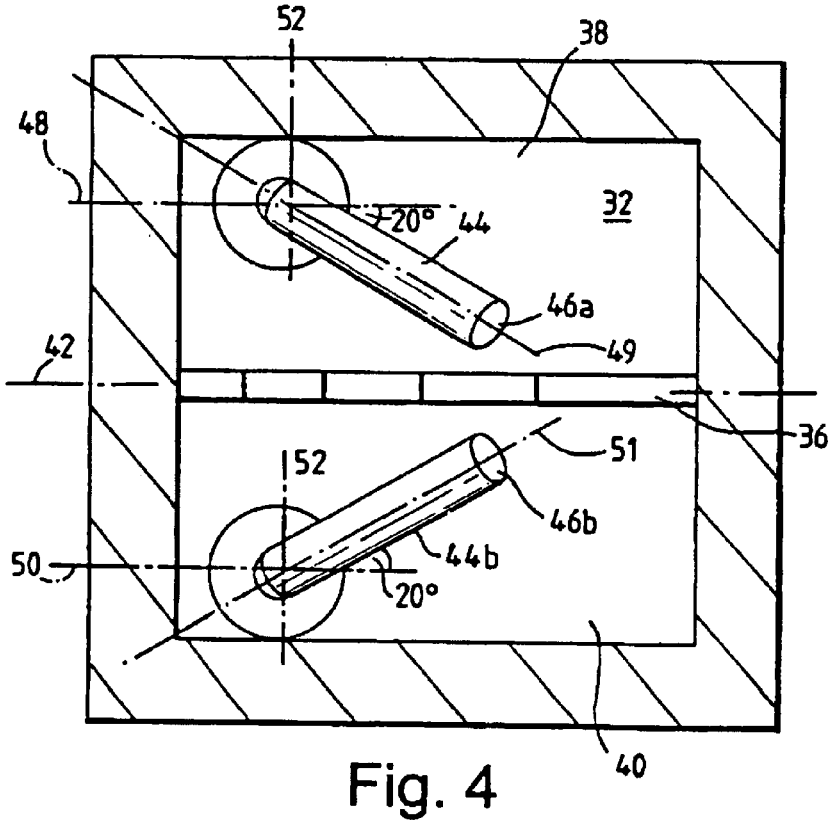
FIG. 4 is a front view of the waveguide of FIG. 2 taken in the direction of arrow 4.
Figure 6A:
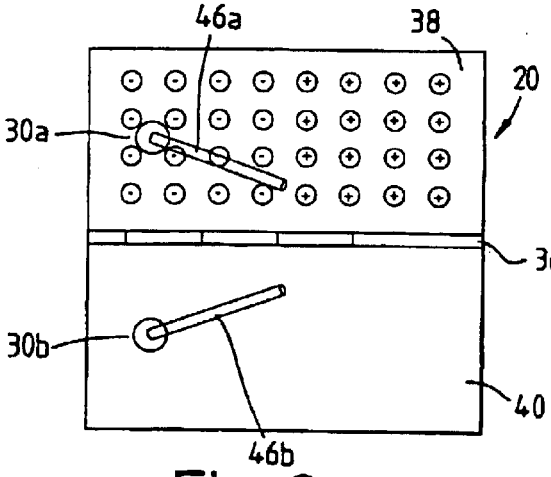
Figure 6B:
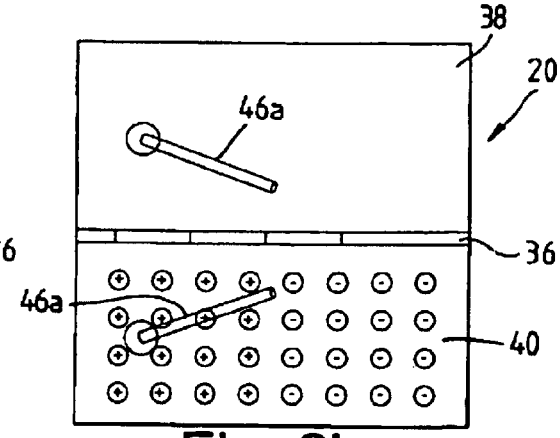
Figure 7A:
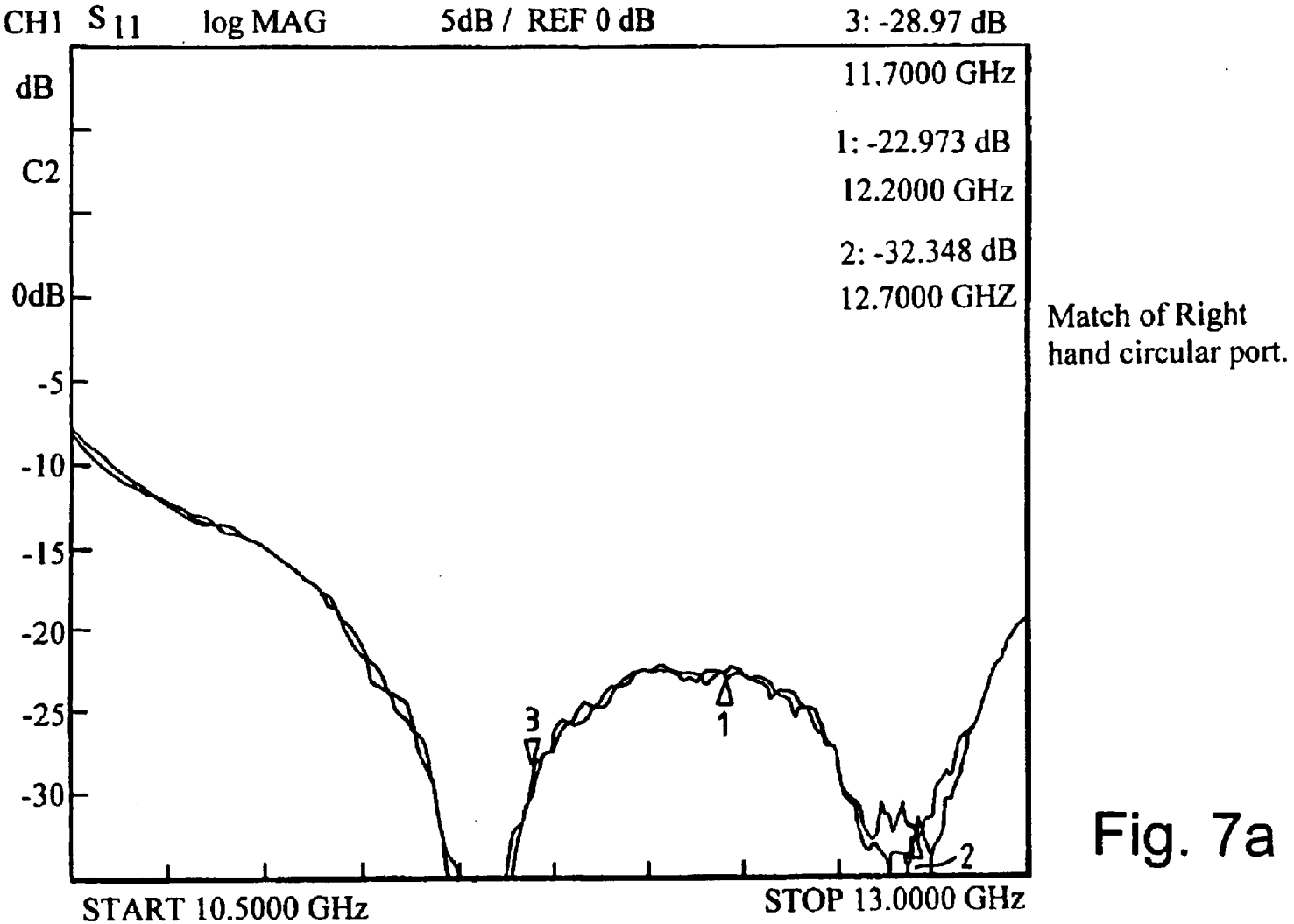
Figure 7B:
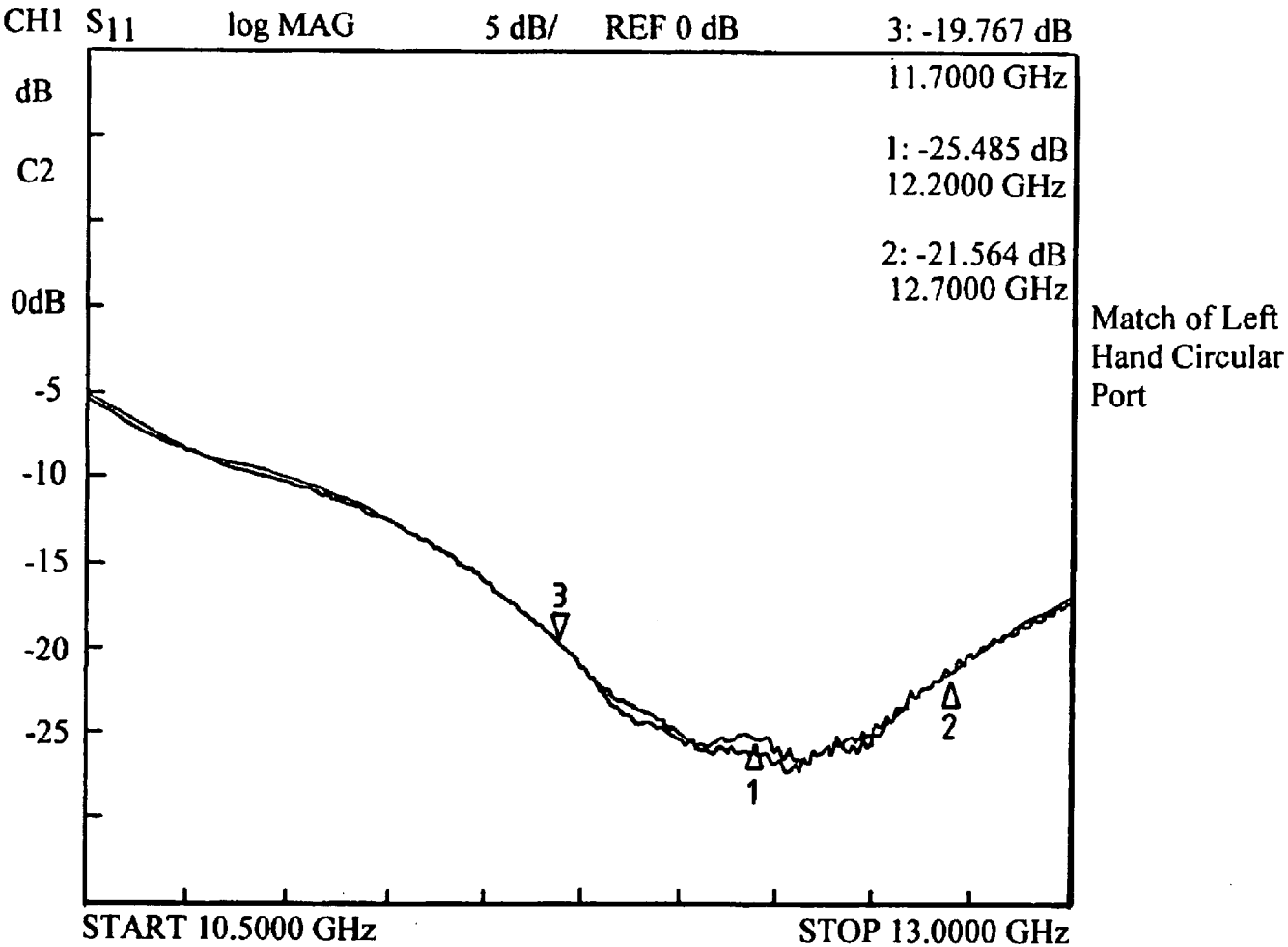
Figure 8:
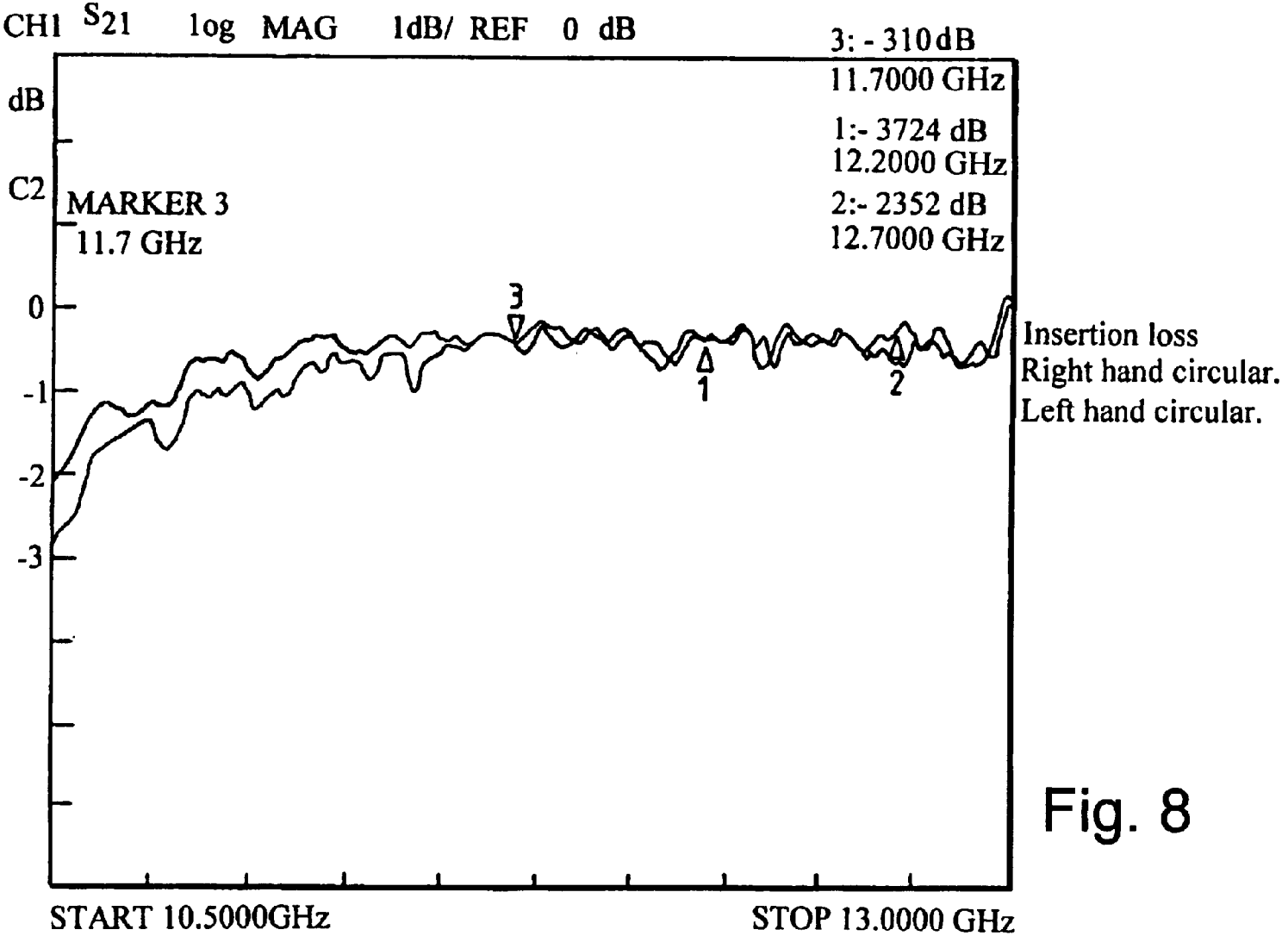
Figure 9A:
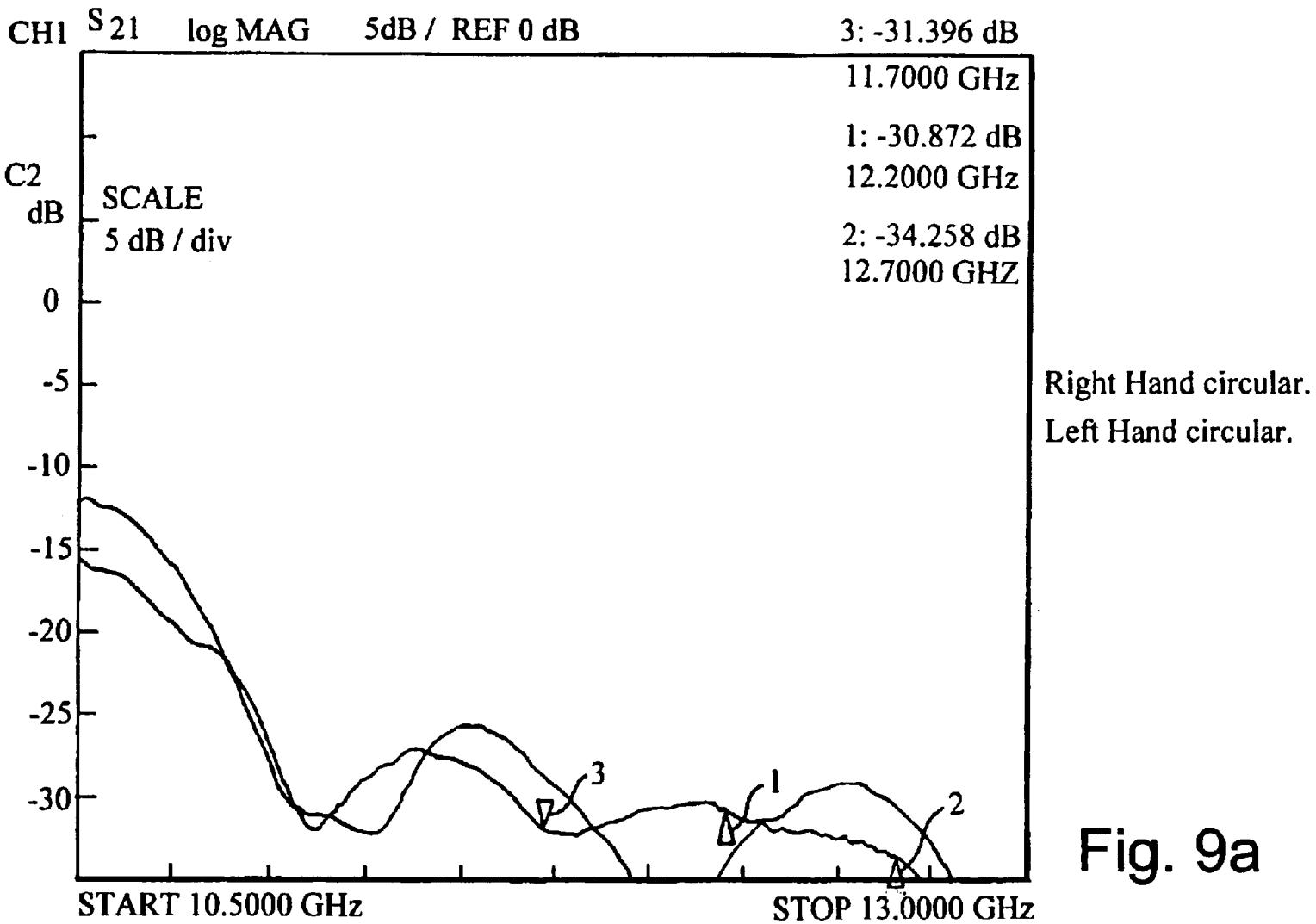
Figure 9B:
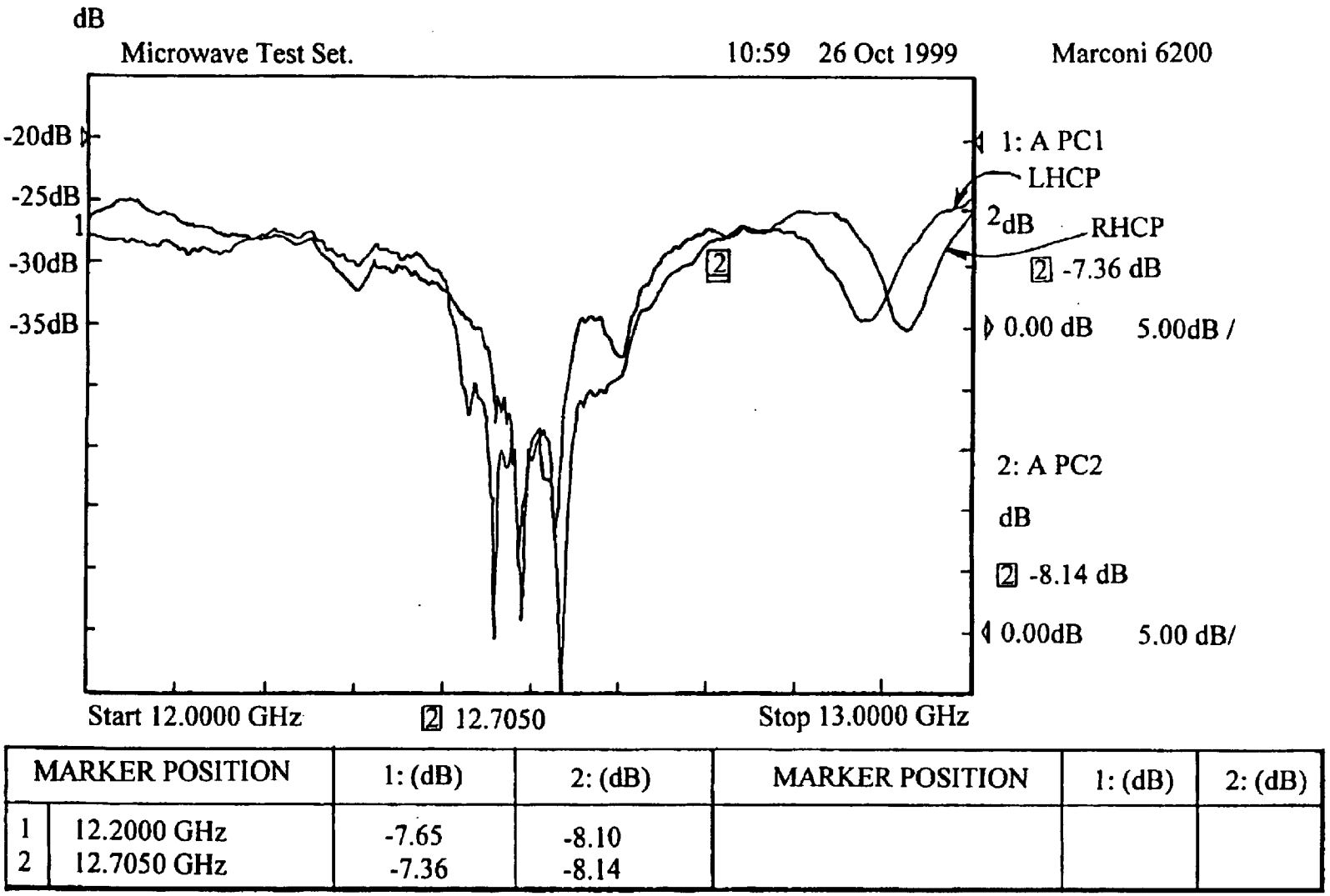
Figure 9C:
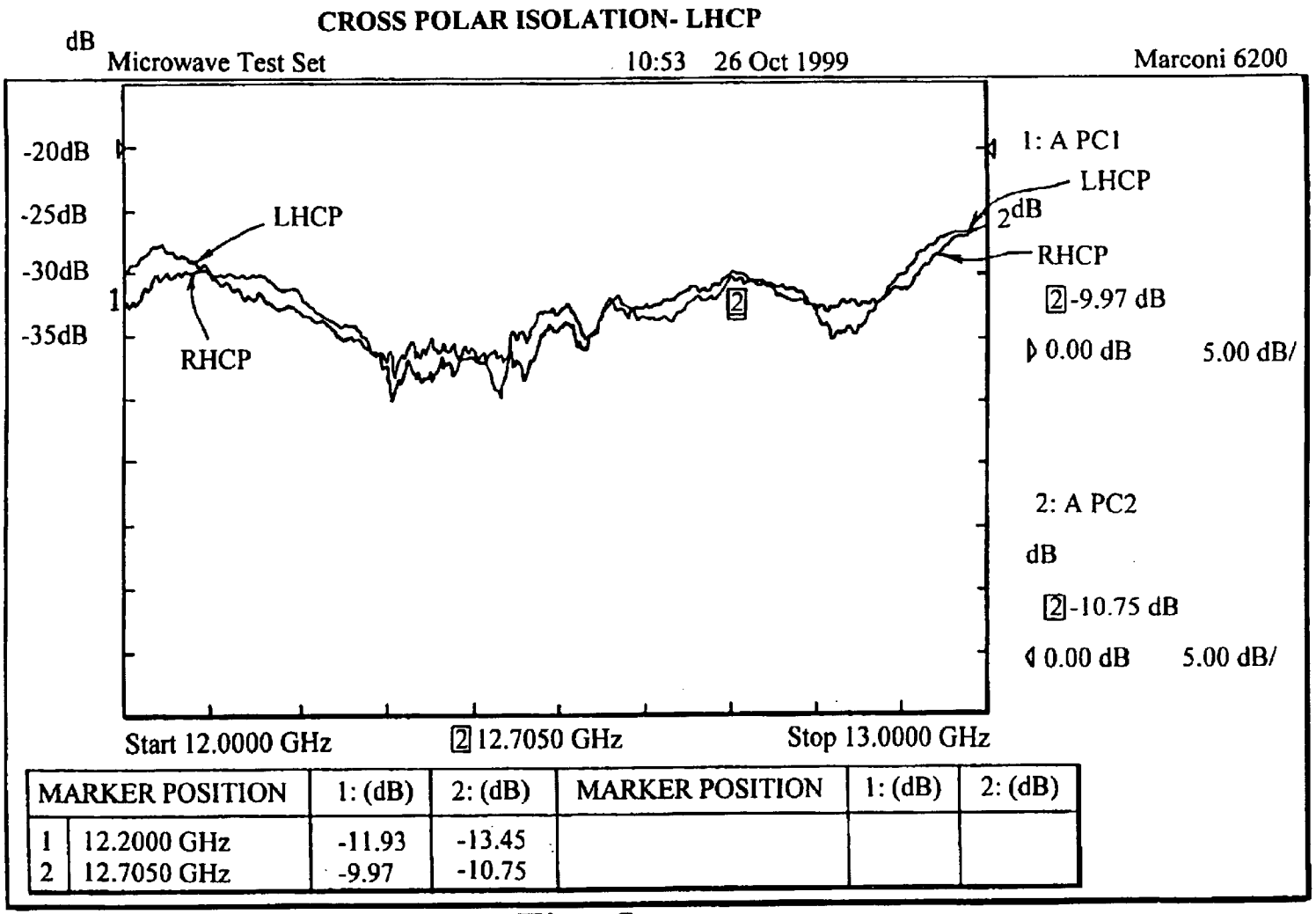
Figure 10:
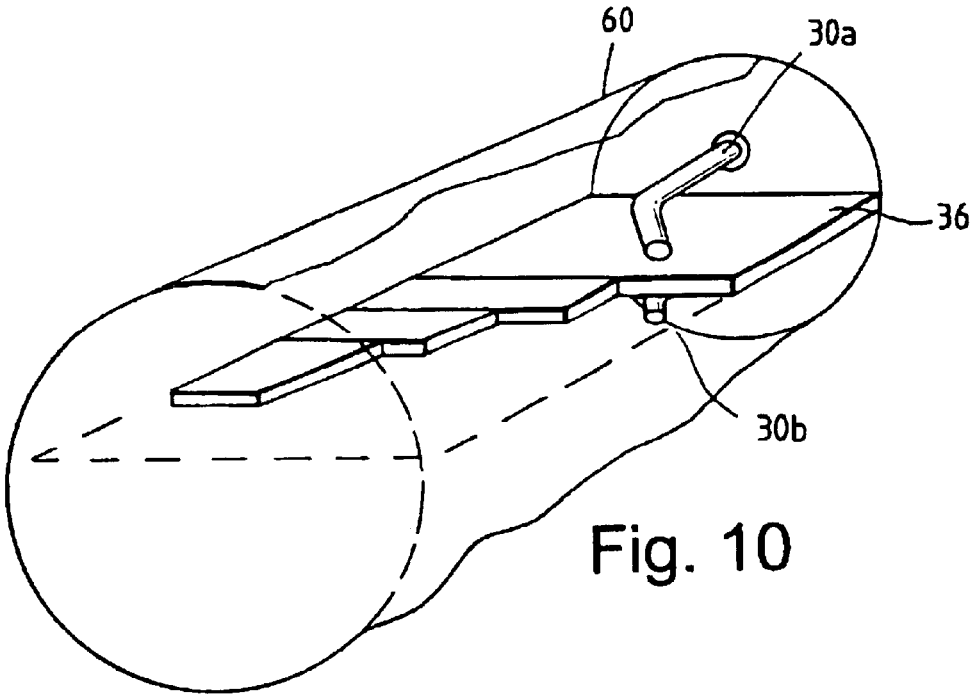
Figure 11A:
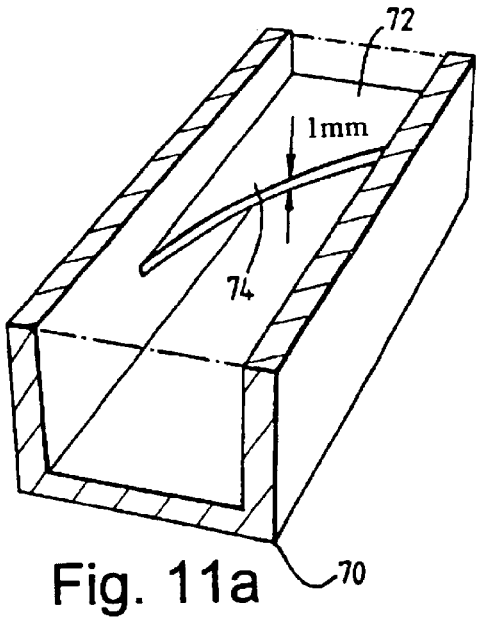
Figure 11B:
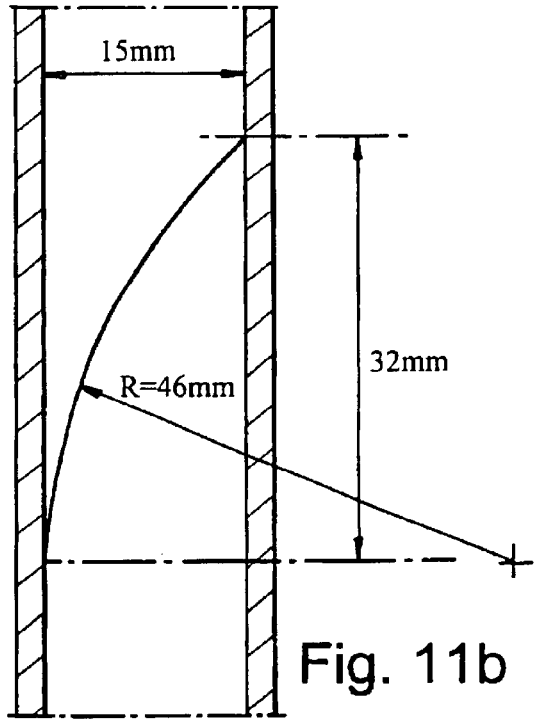
Figure 11C:
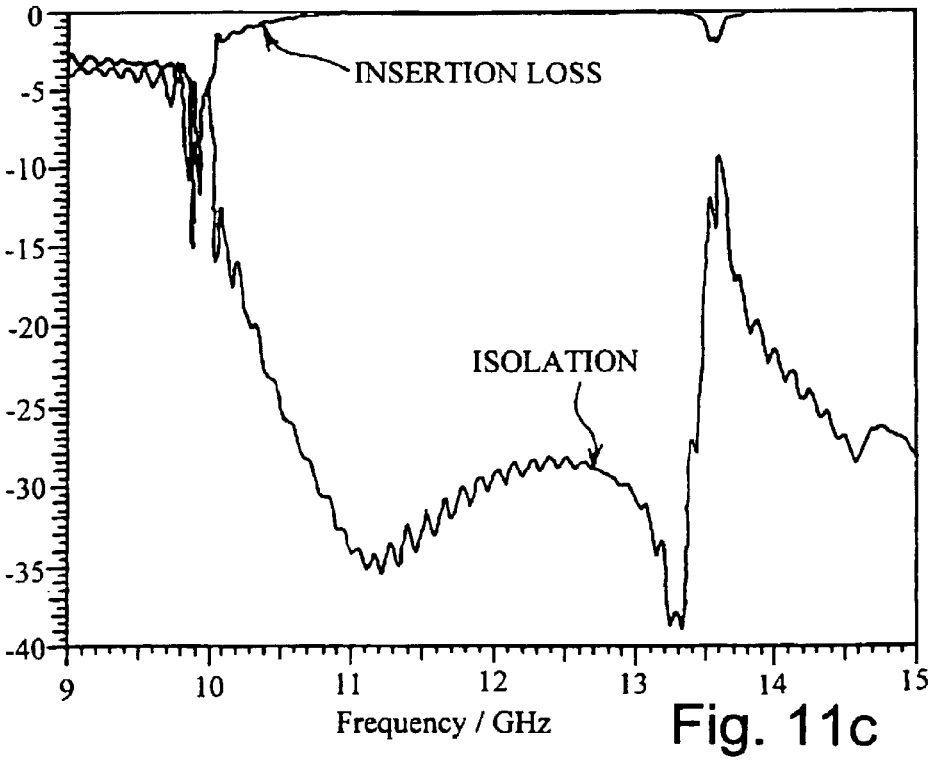

FIGS. 6*a*, 6*b* are similar views to FIG. 4 but depicting the orthogonal magnetic field pattern in each compartment for LHCP and RHCP;

FIG. 7*a* and FIG. 7*b* depict graphs of return loss vs. frequency showing the match of the right and left hand circular ports respectively for the waveguide of FIG. 2;

FIG. 8 is a graph of signal insertion loss versus frequency for the waveguide of FIG. 2;

FIG. 9*a* is a graph of signal isolation (dB) vs. frequency depicting signal isolation in the waveguide;

FIGS. 9*b* and 9*c* are graphs of signal cross-polar isolation (dB) for right-hand circular polarisation (RHCP) versus frequency on the LNB shown in FIG. 1 for right-hand circular polarisation (RCHP) and left hand circular polarisation (LHCP) respectively;

FIG. 10 depicts a perspective and partly broken-away view of a waveguide of circular cross-section in accordance with an alternative embodiment of the invention;

FIGS. 11*a, b* show a waveguide with a curved septum;

FIG. 11*c* shows a plot of insertion loss and cross-polar isolation versus frequency for the waveguide of FIG. 11*a* and FIG. 11*b;*

Figure 3:
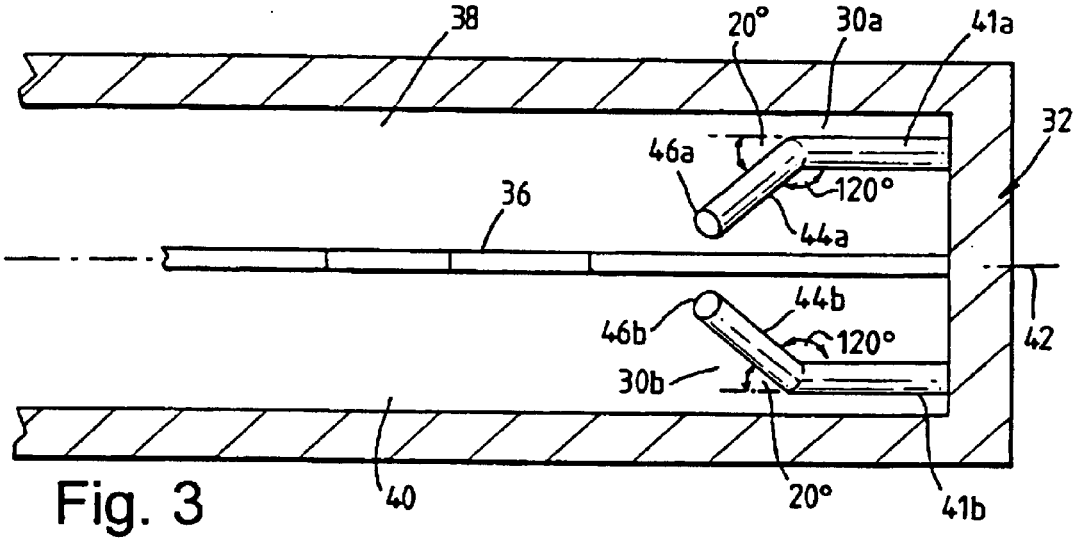
FIG. 3 is a side view of the waveguide of FIG. 2 taken in the direction of arrow 3.
Figure 12:
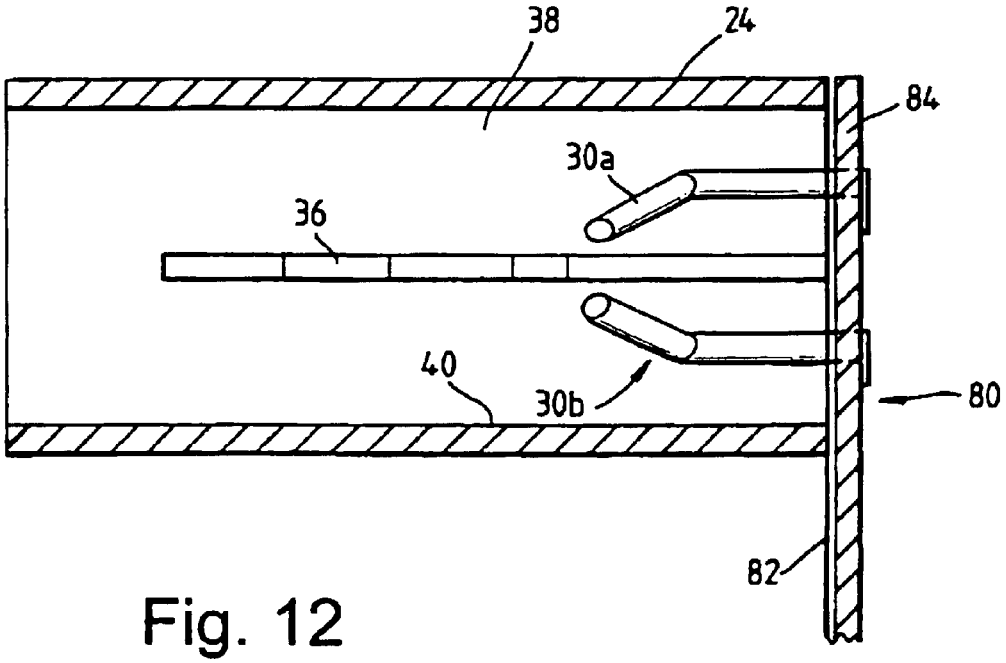
Figure 13A:
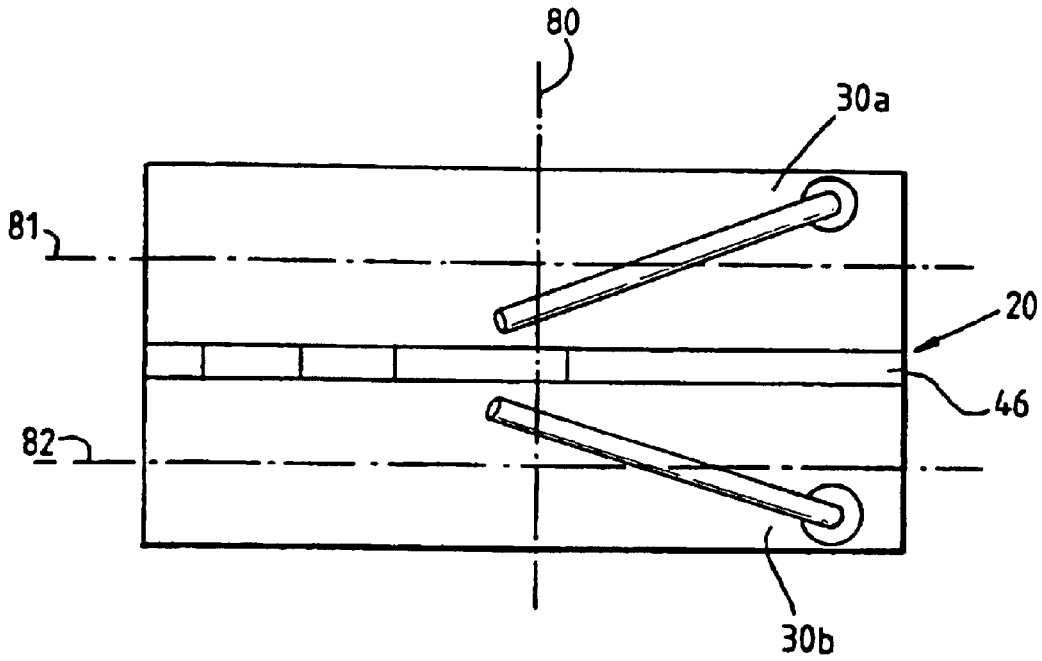

FIG. 12 is a similar view to FIG. 3 but shows the rear wall of the waveguide formed with a ground plane of a printed circuit board, and FIGS. 13*a,b* depict views similar to FIG. 4 of alternative probe arrangement within the waveguide.

Reference is first made to FIG. 1 of the drawings which depicts a low noise block (LNB) generally indicated by the reference numeral 20 which has a corrugated horn 22 coupled to a aluminium alloy (LM24) waveguide 24 of square cross-section which is fabricated with an integral rear wall and integral cast alloy portion 26 which supports a printed circuit board (PCB) 28. The PCB 28 carries two probes 30*a,b* one of which (30*b*) is shown, which pass through the rear wall 32 of the waveguide for detecting a linearly polarised signal which is connected by the PCB to two coaxial connector 34 (only one which is shown in the interest of clarity), from where electrical signals are coupled to a set top box or receiver.

The LNB 20 is particularly suited for the United States market where signals are transmitted using dual circular (left and right) polarisation over a frequency band OF 12.2 to 12.7 GHz. From FIG. 1 it will be seen that the waveguide contains a stepped septum 36 which separates the waveguide into two equal compartments as will be later described, each compartment receiving a probe for detection of the respective polarised signal.

Figure 2A:
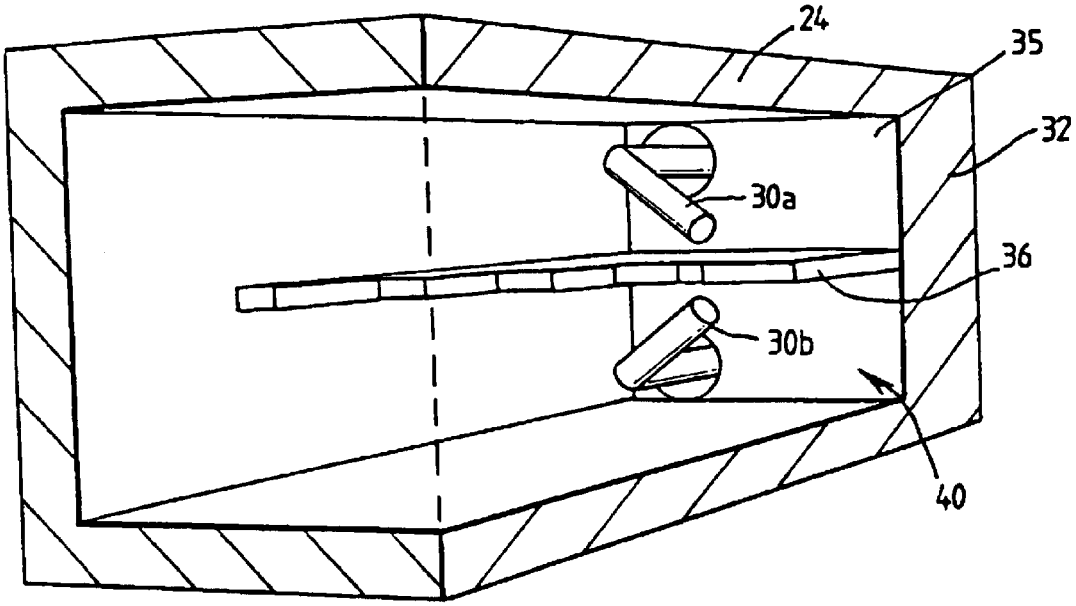
Figure 2B:
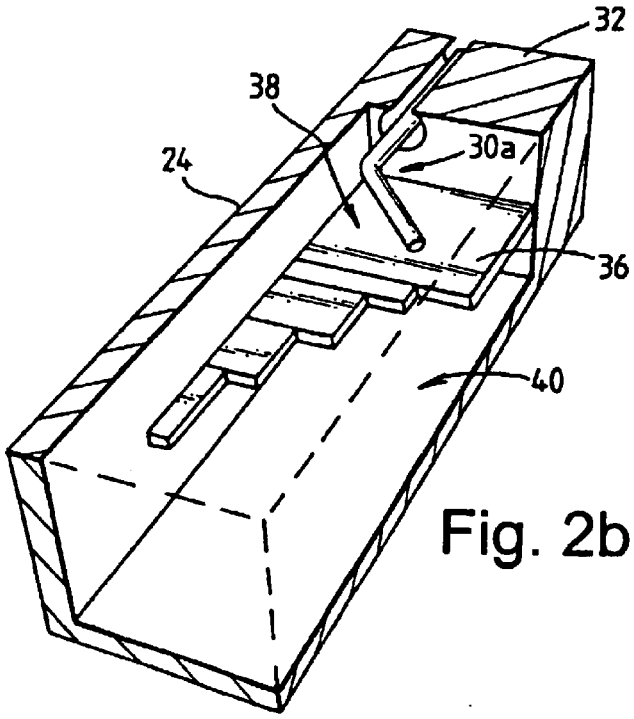

Reference is now made to FIGS. 2*a* and 2*b* of the drawings which depict the waveguide 24 in more detail. The square waveguide 24 is separated into two waveguide compartments 38, 40 by the stepped septum 36. The stepped septum 36, in conjunction with the surrounding waveguide walls, converts the left and right circularly polarised signals into linearly polarised signals over the length of the septum such that by the time the signals reach the septum portion in the vicinity of probes 30*a,b* the signals are linearly polarised for detection by the probes 30*a,b*. In the embodiment shown, the aluminium alloy waveguide is approximately 15.1 mm square; the septum is 44 mm in length, 1.5 mm thick and is also formed with a 1° draft angle per septum side to facilitate manufacture.

Reference is now also made to FIGS. 3 and 4 of the drawings. It will be seen that probes 30*a* and 30*b* are not straight; each probe 30*a*, 30*b* has a first portion 41*a*, 41*b* which extends 7.3 mm into the respective waveguide compartments 38 and 40 in a direction parallel to the septum 36 and main waveguide axis 42. The probes 30*a* and 30*b* then bend into portions 44*a* and 44*b* which are 7.35 mm long and which terminate in probe leading ends 46*a* and 46*b* disposed in proximity to the surface of the septum 36. In the embodiment shown, portions 44*a* and 44*b* are angled to portions 41*a* and 41*b* in planes 49, 51 in which the angles are 120°; best seen in FIG. 3, and the probes 44*a*, 44*b* makes respective angles of 20° with planes 48, 50 as seen in FIG. 4.

This probe design and orientation results in a cross-polar isolation value which exceeds the 25 dB signal isolation standard of the United States and as will be later seen, can approach or exceed 30 dB. The positioning of the free ends of the probes 46*a* and 46*b* in proximity to the septum creates a sufficiently high capacitive coupling with the septum to allow the probes to couple into the magnetic field.

Figure 5:
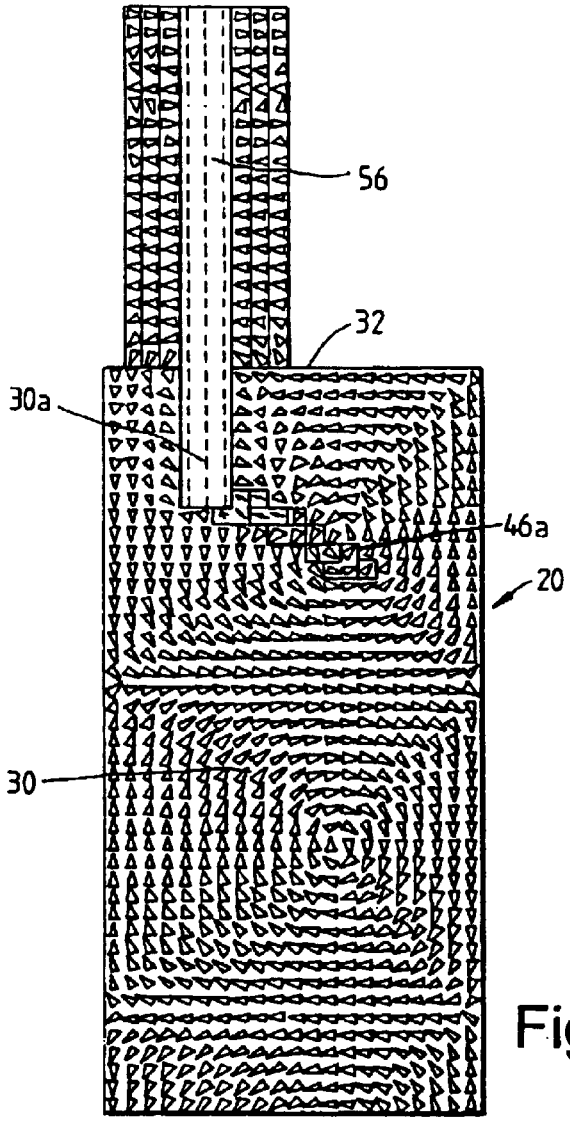
FIG. 5 is a top view of the waveguide of FIG. 2 taken in the direction of arrow 5 and depicting the magnetic field pattern in the top waveguide compartment.

This is best seen in FIG. 5 of the drawings which depicts diagrammatically the magnetic field pattern in the top waveguide compartment 38 of waveguide 20. It will be seen that probe portion 46*a* within the waveguide detects the magnetic field as shown and the resulting detected signal is fed by the probe 30*a* to coaxial section 56.

Reference is also made to FIGS. 6*a* and 6*b* of the drawings which depicts respective magnetic field pattern in each compartment 38 and 40 for detection by the probes 30*a* and 30*b*. In FIG. 6*a* the magnetic field is shown for the converted LHCP polarisation in compartment 38 with field lines coming out of the paper (–) and entering the paper (+). It will be seen that there is minimal field in compartment 40 for this case. FIG. 6*b* shows the field pattern for the converted RHCP with the field lines being arranged in compartment 40 in the opposite direction to FIG. 6*a* and minimal field shown in compartment 38.

Referring now to FIGS. 7*a* and 7*b* of the drawings, which depict the return loss (dB) showing the match of the right-hand circular port and left-hand circular port, it will be seen that the match in both the left-hand circular port and the right-hand circular port is greater than 10 dB across the frequency band of interest which will allow an acceptable noise figure level to be achieved from the LNB.

FIG. 8 of the drawings depicts a graph of the insertion loss (dB) for the waveguide in FIG. 2 for right-hand circular and left-hand circular polarisations. It will be seen that the insertion loss across the band of interest including connectors and feed is less than 1 dB.

Reference is also made to FIG. 9*a* of the drawings which is a graph of signal isolation in the waveguide of FIG. 2 for right-hand circular (RCHP) and left-hand circular polarisations (LHCP). It will be seen from FIG. 9*a* that for both right-hand circular and left-hand circular polarisation the isolation exceeds 25 dB across the band of interest, 12.2–12.7 GHz. For right-hand circular polarisation the isolation exceeds 30 dB across the band of interest. Thus the performance of the waveguide exceeds the 25 dB signal isolation requirement across the frequency band of interest.

Reference is also made to FIGS. 9*b* and 9*c* which are graphs of cross-polar isolation for the dual output LNB shown in FIG. 1 for both the RHCP and LHCP. Each plot contains two isolation traces, one with the opposite output switched to LHCP and one with the opposite output switched to RHCP because the LNB is dual output. It will be appreciated by those skilled in the art that the total isolation figure of an LNB depends on many factors including, but not limited to the cross-polar isolation of the waveguide. FIG. 9*b* depicts the cross-polarisation for the RHCP and it will be seen that the isolation figure for the LNB exceeds 25 dB across the entire frequency band of interest and approaches −30 dB at the upper end of the band for both the LHCP and RHCP signals. Similarly, it will be seen from FIG. 9*c* that the cross-polar isolation for the LNB for LHCP exceeds 30 dB across the frequency band of interest and it exceeds 35 dB at the upper end of the frequency band.

Therefore, it will be understood that in the embodiment of the waveguide described with reference to FIGS. 1 to 9, that this structure provides a waveguide and LNB which satisfies the 25 dB cross-polar signal isolation requirement in a waveguide for receiving left and right hand circular polarisation signals (LHCP and RCHP) with two probes across the frequency band of interest 12.2 to 12.7 GHz.

FIG. 10 of the drawings depicts an alternative embodiment of a waveguide for use in an LNB such as that shown in FIG. 1. In this embodiment the waveguide 60 is circular in cross-section but the shape of the septum 36 and probes 30*a, b,* and the probe orientation is substantially identical to that shown and described in relation to the first embodiment. This arrangement produces a similar performance to that of the square cross-section waveguide 24.

It will also be appreciated that various modifications may be made to the waveguide structures hereinbefore described without departing from the scope of the invention. In the structure described with reference to FIGS. 1 to 9 and the structure FIG. 10, it will be seen that the septum is stepped. However, septum does not require to be stepped and a smoothly curved septum could be used instead. Reference is made to FIG. 11*a* which depicts a waveguide 70 with a septum 72 which is non-stepped and which has a continuously curved edge 74. The septum is 1 mm thick, 15 mm wide and the edge 74 is defined by the radius of a circle of radius 46 mm as shown in FIG. 11*b*.

FIG. 11*c* shows the principal performance parameters of waveguide 70. It will be seen that the insertion loss over the frequency band of interest is minimal and the isolation loss over the same band of interest exceeds 25 dB, also exceeding the U.S. specification requirement.

Reference is now made to FIG. 12 of the drawings which depicts an alternative probe-mounting structure for the waveguide 24. In FIG. 12, it will be seen that the waveguide 24 has a rear wall 80 which is formed by the ground plane 82 of a printed circuit board 84. Probes 30*a* and 30*b* pass through the ground plane and are coupled to tracks on the circuit board 80. This construction has the advantage that the square or circular waveguide is easier to manufacture and the ground plane of the circuit board can be utilised as the rear wall of the waveguide. Performance figures for the structure shown in FIG. 12 are similar to those for the arrangement described with reference to FIGS. 1 to 9.

Figure 13B:
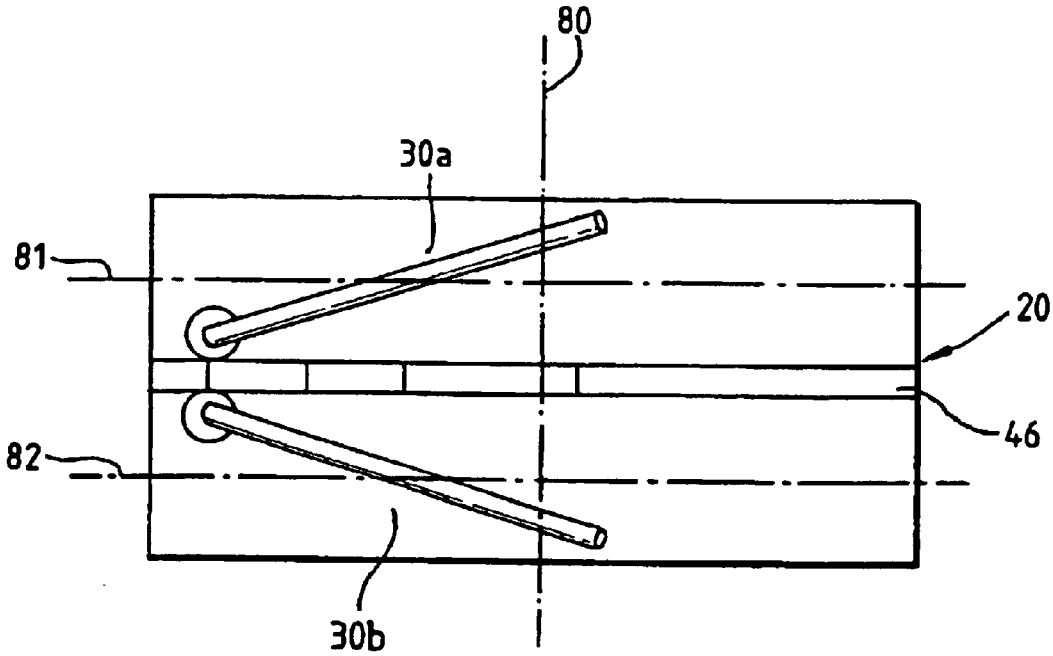

Further modifications may be made to the embodiments hereinbefore described without departing from the scope of the invention. For example, the angle between probe portions 41 and 44 does not require to be 120° or an obtuse angle. It may be a right-angle or even an acute angle. It will be appreciated, the angles between planes 49, 48 and 51, 54 may be varied slightly with minimal degradation of performance. The leading ends of the probe require to be located in proximity to the waveguide wall or septum such that a relatively high capacitance is created to achieve satisfactory magnetic coupling to the probes. FIGS. 13*a*, 13*b* depict alternative probe arrangements. FIG. 13*a* shows the probes reflected about plane 80 but still converging towards septum 36. FIG. 13*b* shows the probe 30*a* reflected about plane 81 and 30*b* reflected about plane 82 with respect to the orientation shown in FIG. 4. The probes in FIG. 13*b* diverge from the septum with the free ends of the probes disposed in proximity to the waveguide walls. Each of these arrangements provide an isolation performance which meets the 25 dB isolation specification. Each probe may be disposed in its respective compartment such that it is reflected about one or both of the planes bisecting the compartment with the free end of the probe disposed in proximity to the waveguide or the septum surface to allow the probe to capacitively couple into the magnetic field of the primary or fundamental waveguide mode in the waveguide compartment. It will be appreciated that this allows a total of sixteen possible arrangements for the probes. The leading end of each probe is located such that the match exceeds 10 dB across the band of interest. Furthermore, the probes do not require to be shaped as shown in the drawings. A straight or a curved probe is sufficient as long as the leading ends of the probes are located in proximity into the waveguide or septum such that the capacitance coupling achieves the appropriate magnetic coupling of the signal of the waveguide in order to meet the performance targets. It will be appreciated that a great many probe shapes may achieve this solution.

It will also be appreciated that the waveguide may be diecast in alloys other than aluminium, for example, zinc alloy, MAZAC, or magnesium alloy AZ91D, as well as being diecast from the elements zinc, aluminium and magnesium themselves. It will also be appreciated that the waveguide hereinbefore described with reference to the LNB may be used with different types of waveguide horns and LNB structures which are different to that shown in FIG. 1 for use in different jurisdictions.

It will be appreciated that the design is reciprocal and can be used to generate LHCP and RHCP in a transmitter rather than receiving these signals in an LNB. This would occur by energising the probes in the compartments to generate the appropriate fields in the waveguide.

It will be appreciated that the principal advantage of the invention hereinbefore described is that a waveguide structure is provided which meets the U.S. isolation requirements across the full frequency range.

What is claimed is:

1. A dual probe waveguide structure for use in a LNB (low noise block) for receiving a left (L) and a right (R) circularly polarised electromagnetic radiation signal and for converting the circularly polarised signals into linearly polarised signals, the waveguide structure comprising a waveguide housing of a substantially symmetrical cross section, said waveguide housing having a front aperture and a rear waveguide wall, wherein the waveguide wall is provided by a ground plane of a circuit board disposed at the end of the waveguide, a septum disposed within the housing and coupled to the rear waveguide wall and the housing to separate the waveguide into two waveguide compartments, one compartment for receiving and converting the left circular polarisation signal into a first linearly polarised signal and the other compartment for receiving and converting the right circular polarised signal into a second linearly polarised signal orthogonal to the first linearly polarised signal, a first probe extending into said first waveguide compartment from the rear waveguide wall and a second probe extending into the second rear waveguide compartment from the second waveguide wall the first and second probes each having a free end, the probes being oriented and arranged such that the free ends of the probes are disposed in proximity to the waveguide wall or septum in each respective compartment such that the probes capacitively couple into the magnetic field of the primary or fundamental waveguide mode in the waveguide compartment.

2. A waveguide structure as claimed in claim 1 wherein the waveguide housing is square in cross-section.

3. A waveguide structure as claimed in claim 1 wherein the waveguide housing is circular in cross-section.

4. A waveguide structure as claimed in claim 1 wherein the septum is stepped.

5. A waveguide structure as claimed in claim 1 wherein the septum is non-stepped and has a curved edge.

6. A waveguide structure as claimed in claim 1 wherein the rear wall of the waveguide is integral with the waveguide housing.

7. A waveguide structure as claimed in claim 1 wherein two probes are mounted in the circuit board, one probe extending into a respective compartment.

8. A waveguide structure as claimed in claim 7 wherein the probes, are circular in cross-section.

9. A waveguide structure as claimed in claim 7 wherein the probes are of any other suitable cross-section, such as square, rectangular, hexagonal or triangular, which maximises the coupling of the magnetic field from the compartment.

10. A waveguide structure as claimed in claim 1 wherein each of the probes has a first portion which extends substantially parallel to the waveguide axis into the respective waveguide compartment and a second portion coupled to the first portion at an obtuse angle, each second portion having its free end disposed towards the septum and the leading end of the other probe.

11. A waveguide structure as claimed in claim 10 wherein the free ends of the probes converge towards each other and towards the septum.

12. A waveguide structure as claimed in claim 10 wherein the free ends of the probes diverge from the septum towards the waveguide wall.

13. A waveguide structure as claimed in claim 1 wherein the probes are located in respective compartments such as to be reflected about the plane of the septum.

14. A waveguide structure as claimed in claim 1 wherein the waveguide housing, rear wall and septum, are formed from a die-cast metal selected from aluminum, zinc, magnesium or alloys of these elements such as MAZAC, a zinc alloy; LM24, an aluminum alloy, and AZ91D, a magnesium alloy.

15. A waveguide structure as claimed in claim 1 wherein the septum is substantially the same thickness from the rear wall to the stepped or curved edge of the septum, the septum having a draft angle about 1° per side to facilitate release of the waveguide after being die-cast.

* * * * *

UNITED STATES PATENT AND TRADEMARK OFFICE

CERTIFICATE OF CORRECTION

PATENT NO. : 6,839,037 B1
DATED : January 4, 2005
INVENTOR(S) : Andrew P. Baird et al.

It is certified that error appears in the above-identified patent and that said Letters Patent is hereby corrected as shown below:

Title page,
Item [54], Title, please delete "DUAL CIRCULAR POLARIZATION WAVEGUIDE SYSTEM" and substitute -- DUAL CIRCULAR POLARITY WAVEGUIDE SYSTEM --.

Signed and Sealed this

Twelfth Day of April, 2005

JON W. DUDAS
*Director of the United States Patent and Trademark Office*